US007415859B2

(12) United States Patent
Ser et al.

(10) Patent No.: US 7,415,859 B2
(45) Date of Patent: Aug. 26, 2008

(54) METHOD AND APPARATUS FOR FORMING BLIND HOLES IN SHEET MATERIAL

(75) Inventors: Song Cheh Ser, Singapore (SG); Weng How Leong, Singapore (SG)

(73) Assignee: Metalform Asia PTE Ltd., Singpore (SG)

( * ) Notice: Subject to any disclaimer, the term of this patent is extended or adjusted under 35 U.S.C. 154(b) by 111 days.

(21) Appl. No.: 11/289,648

(22) Filed: Nov. 30, 2005

(65) Prior Publication Data

US 2006/0236519 A1 Oct. 26, 2006

(30) Foreign Application Priority Data

Dec. 1, 2004 (SG) ..... 200407251-8
Mar. 18, 2005 (SG) ..... 200502892-3

(51) Int. Cl.
*B21D 31/06* (2006.01)
*B21J 13/00* (2006.01)

(52) U.S. Cl. ..... 72/355.6; 72/379.2; 72/377

(58) Field of Classification Search ..... 72/379.2, 72/355.6, 355.2, 355.4, 377, 325
See application file for complete search history.

(56) References Cited

U.S. PATENT DOCUMENTS

| | | | | |
|---|---|---|---|---|
| 866,021 | A * | 9/1907 | Hansen | 72/325 |
| 1,124,359 | A * | 1/1915 | Taylor | 72/334 |
| 1,652,208 | A | 12/1927 | McEvoy, Jr. | |
| 3,141,358 | A | 7/1964 | Burke, Jr. et al. | |
| 3,387,481 | A | 6/1968 | Harvey et al. | |
| 3,490,121 | A | 1/1970 | Biehl et al. | |
| 3,731,369 | A * | 5/1973 | Johnson | 29/509 |
| 4,177,665 | A * | 12/1979 | Schurmann | 72/359 |
| 6,018,976 | A | 2/2000 | Wolf | |
| 6,176,266 | B1 | 1/2001 | Huber et al. | |
| 6,408,669 | B1 | 6/2002 | Meeker et al. | |
| 7,013,696 | B2 * | 3/2006 | Ando et al. | 72/355.6 |

OTHER PUBLICATIONS

Related U.S. Appl. No. 11/289,638, filed Nov. 30, 2005; Inventors: Ser et al.
Office action issued in U.S. Appl. No. 11/289,638, dated May 21, 2007.
Office action issued in U.S. Appl. No. 11/289,638, dated Jul. 12, 2007.

* cited by examiner

*Primary Examiner*—Daniel C Crane
(74) *Attorney, Agent, or Firm*—Nixon & Vanderhye P.C.

(57) ABSTRACT

A method of forming blind holes in a sheet material is provided. The method includes forming a recessed segment in the sheet material, stamping the recessed segment between a tapered punch and a pad to form a blind hole having a sealed end and a sidewall, wherein the pad includes a profiling pin that is enclosed by the sealed end and the sidewall. The method further includes forming a material channel interposed between the tapered punch and a tapered die, and compressing the material channel to generate a material flow into the sidewall. The material channel may be narrowed to allow more material flow into the sidewall for additional sidewall thickness.

6 Claims, 9 Drawing Sheets

METHOD AND APPARATUS FOR FORMING BLIND HOLES IN SHEET MATERIAL

BACKGROUND

1. Field of the Invention

The present invention relates to a method for processing a sheet of material. More particularly, it relates to methods of forming blind holes in a sheet of material.

2. Description of the Related Art

A blind hole is a hollow projection with an opening at one end and closed at the opposite end. Blind holes have wide applications ranging from locking mechanisms to electronic devices. They are useful in situations where through holes would render a less refined appearance than desired. Blind holes are also useful in applications requiring air-tightness, such as in hard disk drives where airflow may contaminate the interior of the hard drive. In such applications, blind holes may be formed in the casing for mounting printed circuit boards (PCB), motors, and semiconductor chips.

A conventional method of forming a blind hole begins by drilling a through hole in sheet material. One end of the through hole is then closed by placing a seal over that end. One problem arising from this method is that the depth of the hole is limited to the thickness of the sheet material. Using a thicker sheet of material will enable the construction of a deeper blind hole. However, in portable devices, where weight and form factor are crucial having a thick sheet of material is not practical. Another problem arises with the use of seals to close the through hole. The typical seals or plugs may not provide an airtight seal, and hence the seal would not be an adequate seal for a blind hole of a hard disk drive casing.

Another method of forming a blind hole is by controlling the depth of drilling into a sheet material. Unfortunately, one of the problems arising from this method is that the depth of the hole is limited to the thickness of the sheet material. Further, drilled material bits may be trapped in the blind hole and require additional effort to remove. Removing the debris from the blind hole is usually accomplished by using compressed air, which may lodge flying debris on other parts of the sheet material.

Another conventional method of forming a blind hole begins by compressing the sheet material against a die having an orifice therein. A portion of the sheet material is then extruded into the orifice by the compression to form an extruded portion by employing a ram press. A post is then forcibly inserted into the extruded portion of the sheet material so that the extruded portion forms a hollow projection around the post The insertion of the post is controlled so that a through hole will not be formed.

When the post is withdrawn, a blind hole or hollow projection having a closed end at the sheet material is formed. One problem with this compression method is that a recess or indentation may be formed at the side of the compressed sheet when the sheet material is forcibly extruded into the orifice. This deformation may be a thinned and weakened spot in the closed end of the blind hole. Another problem is that the sheet material experiences stretching and stress from the compression, which may weaken the sheet material or even cause failure.

Additionally, with this method, the sidewall height of the blind hole projecting or extruding from the sheet material can be increased, but at the expense of the sidewall thickness of the blind hole sidewall. To achieve an increased extrusion height, a post having a larger diameter is required. Accordingly, the sidewall is necessarily thinned out to provide material for the increased height. If the blind hole is further tapped to cut screw threads, the sidewall will be weakened and prone to breakage.

In view of the foregoing, it is therefore desirable to have a method and apparatus for forming blind holes in a sheet material hating increased projection or extrusion height and greater sidewall thickness.

SUMMARY OF THE INVENTION

The present invention provides for a method and apparatus for forming a blind hole in a sheet martial. Several inventive embodiments of the present invention are described below.

According to one embodiment of the invention, the method of forming blind holes in a sheet material includes forming a recessed segment in the sheet material, stamping the recessed segment between a tapered punch and a pad to form a blind hole having a sealed end and a sidewall. The tapered punch includes a contact surface having a recess enclosed by a tapered ridge, which defines the sealed end of blind hole.

To increase the sidewall thickness, a material channel is formed and interposed between the tapered punch and a tapered die. The material channel is compressed to generate a material flow into the sidewall of the blind hole to narrow or constrict the thickness of the material channel. As such, the material channel can be less thick than the sidewall. A sufficiently thick sidewall renders a more sturdy blind hole sidewall and is less prone to breakage when the blind hole is tapped to form threads in the internal sidewall.

An advantage of forming the blind hole in a recessed segment in the sheet material is that the resultant blind hole sidewall has an increased extrusion from the sheet material. In hard disk applications, blind holes on a hard disk casing with increased sidewall extrusion are able receive longer screws for mounting a thicker PCB securely.

The method of forming blind holes according to the present invention is particularly advantageous as the closed end of the blind hole is rendered airtight. Further, the maximum depth of the blind hole is no longer constrained by the thickness of the sheet material. Instead, the method allows the depth of the blind hole to be greater than the thickness of the sheet material if required by a user.

Hence, cost and weight of materials can be reduced. With a deeper blind hole, screw threads can be made longer, resulting in a more secured fastening of the PCB, motor or other elements to a base plate made from the sheet material. This is especially desirable in portable devices, where form factor and secured fastening are of paramount importance.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION

Figure 1:
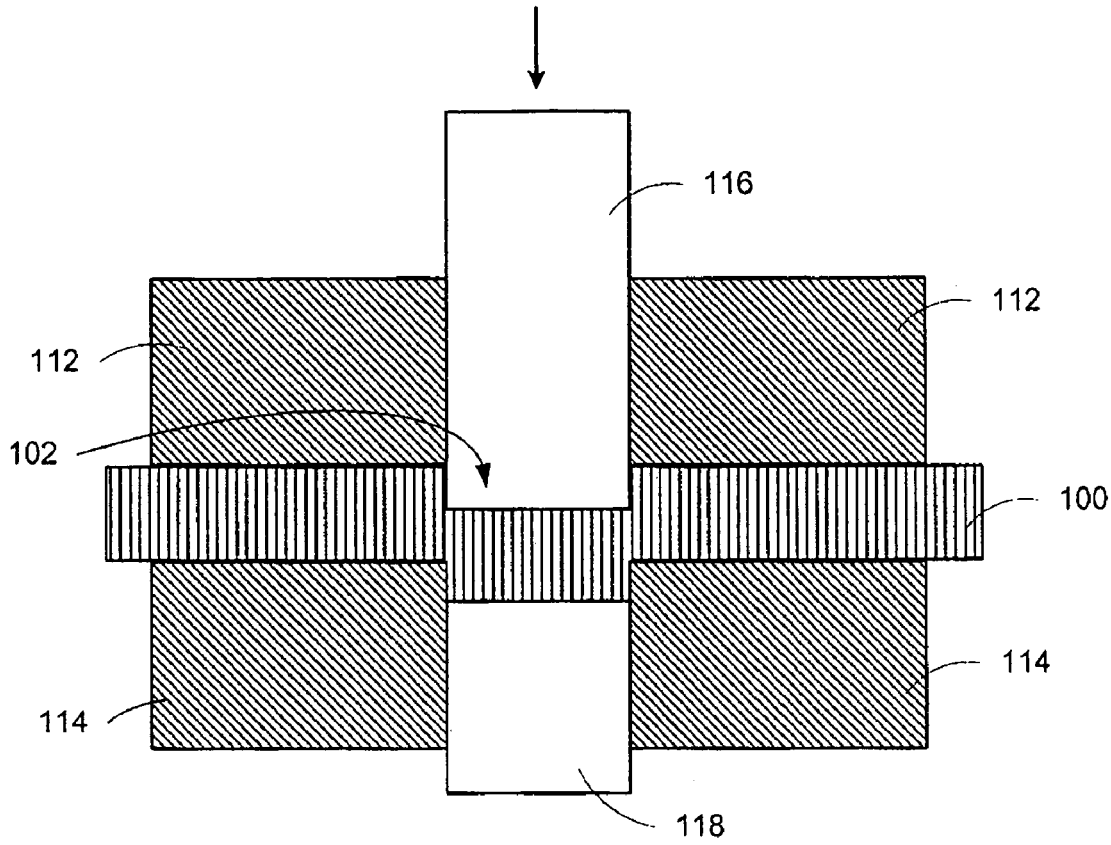
FIG. 1 is a partial cross sectional view showing a flat pin punching against a sheet material to form a recessed segment in the sheet material.

Methods of processing a sheet material to form blind holes are provided. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention FIG. 1 illustrates a process of forming a recessed segment 102 in a sheet material 100. The sheet material 100 is secured between an upper die 112 and a lower die 114. A support pin 118 is placed under the sheet material 100 to receive the recessed segment 102 and to define the depth of the recessed segment. A flat pin 116 is used to punch the sheet material 100 from its top surface against the first support pin 118 to form the recessed segment 102 on the sheet material 100. An advantage of the recessed segment is that the resulting blind hole has an increased projection extending from the bottom surface of the sheet material 100.

Figure 2:
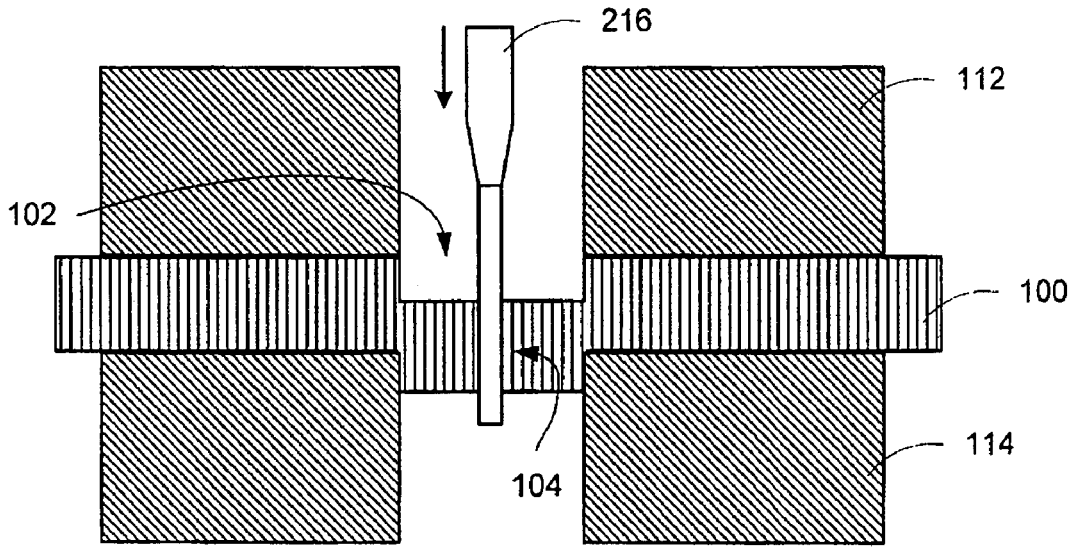
FIG. 2 is a partial cross sectional view showing a narrow pin driven through the sheet material to form a hollow projection.

FIG. 2 illustrates a process of forming a hollow projection 104 by driving or punching a narrow pin 216 through the recessed segment 102 from the top surface of the sleet material 100. The narrow pin 216 has a smaller diameter than that of the flat pin 116. Using a narrow pin to form a through hole prevents excessive stretching and chipping of the sheet material 100 when the narrow pin 216 is driven through the sheet material 100. The hollow projection 104 is defined by a top opening formed at one end in the recessed segment 102, a bottom opening at the opposite end, and a sidewall therebetween defining the depth of the hollow projection 104.

Figures 3A, 3B:
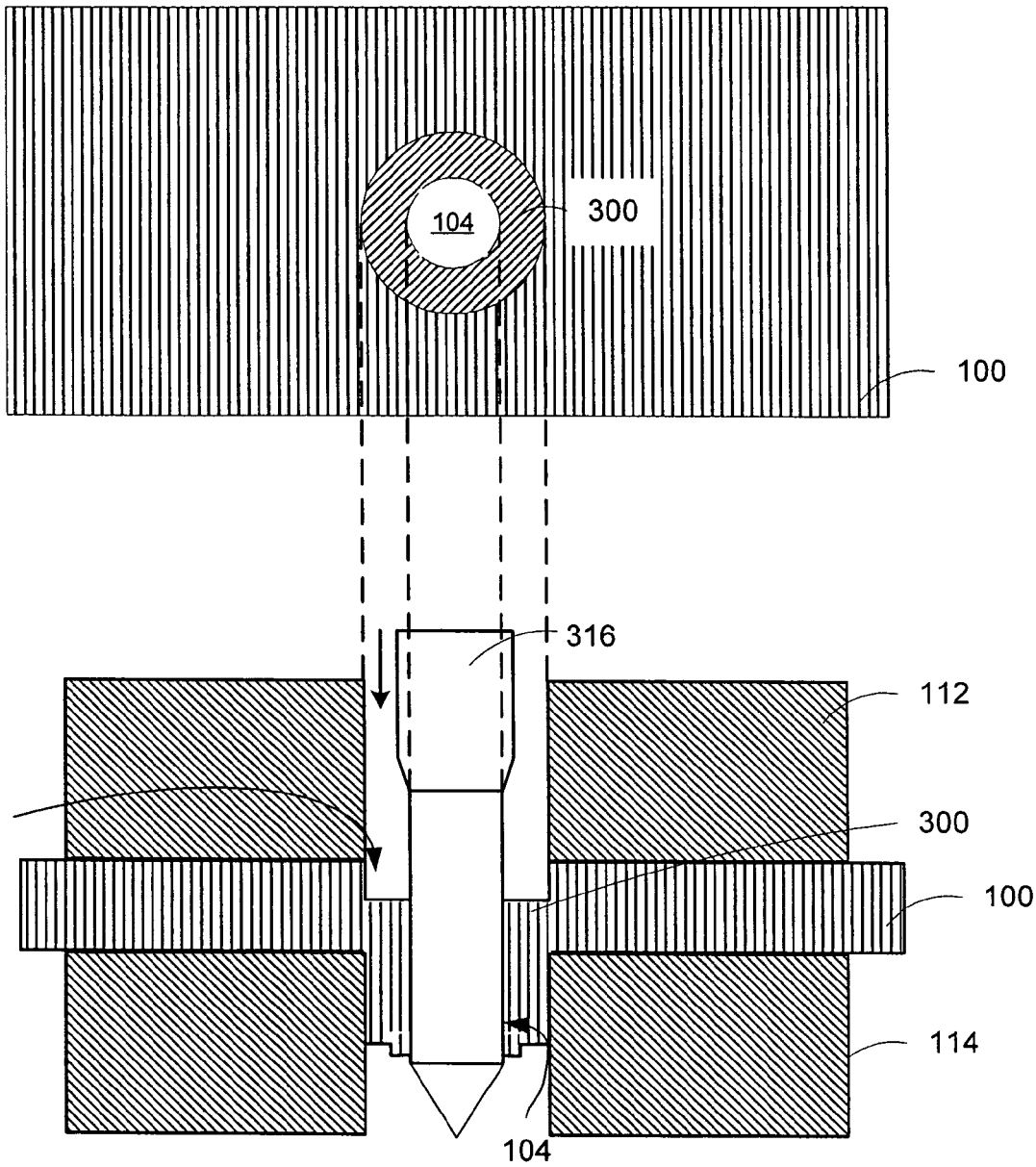
FIG. 3A is a partial cross sectional view showing an enlarging pin driven through the hollow projection.
FIG. 3B is a top view of the sheet material of FIG. 3A.
Figure 8:
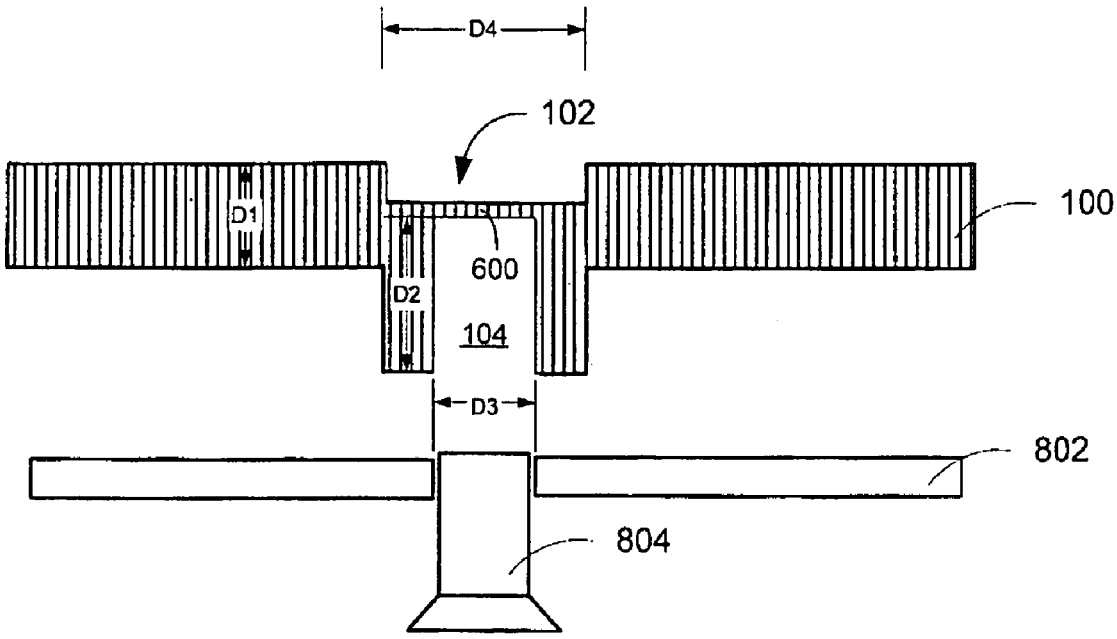
FIG. 8 shows a cross-sectional view of a blind hole formed in a sheet material according to a first aspect of the present invention.

Depending on the requirements of sheet material 100, the hollow projection 104 at this stage may not have the desired internal diameter D3 (as shown in FIG. 8) and may require enlarging. FIG. 3A illustrates a process of enlarging the hollow projection 104 to a desired internal diameter of the resulting blind hole. An enlarging pin 316, of the desired diameter, is inserted through the hollow projection 104. While the enlarging pin 316 is driven or punched through the hollow projection 104, the enlarging pin 316 forces the sheet material 100 radially from the shaft of the enlarging pin 316. Since the sheet material 100 is secured by the upper 112 and lower 114 dies, the material is forcibly exuded at the bottom opening of the hollow projection 104, thereby increasing the depth of the hollow projection (shown in FIG. 3A).

FIG. 3B shows a top view of the sheet material 100 of FIG. 3A having a layer of material 300, adjacent to the top opening of the hollow projection 104, which will be shifted towards the center of the top opening of the hollow projection 104 to form a continuous layer 600 (shown in FIG. 6) to seal the top opening.

Figure 4:
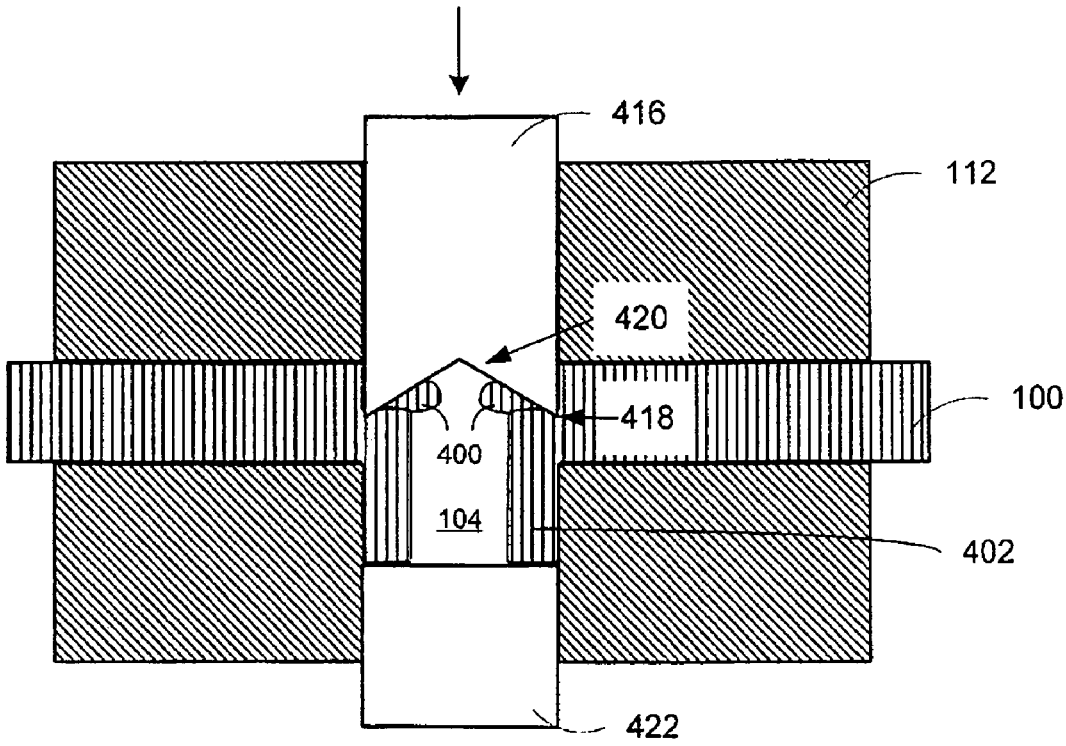
FIG. 4 is a partial cross sectional view showing a first tapered pin shearing material towards the center of the top opening of the hollow projection.

FIG. 4 illustrates a process to begin scaling the top opening of the hollow projection 104 by using a first tapered pin 416 to shear material towards the center of the top opening. The first tapered pin 416 includes a cutting edge 418 for shearing the sheet material and a tapered internal wall 420 to shift a mass of sheared material 400 to flow towards the center of the top opening of the hollow projection 104. A lower support pin 422 may be inserted between the lower dies 114 to prevent sidewalls 402 of the hollow projection 104 from undue deformation or displacement, and to flatten the sheet material 100 adjacent the bottom opening of the hollow projection 104. Depending on the desired internal diameter D3 of the hollow projection 104, further shearing may be required to form a continuous layer 600 over the top opening.

Figure 5:
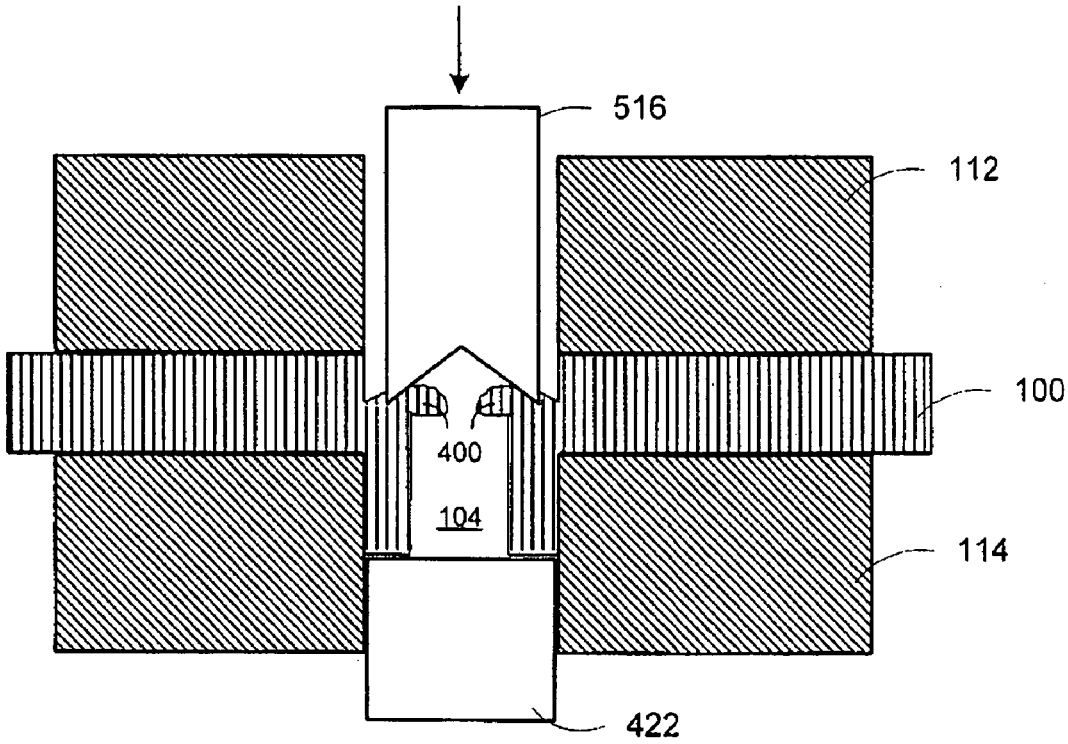
FIG. 5 is a partial cross sectional view showing a second tapered Pin shearing material towards the center of the top opening of the hollow projection.
Figure 6:
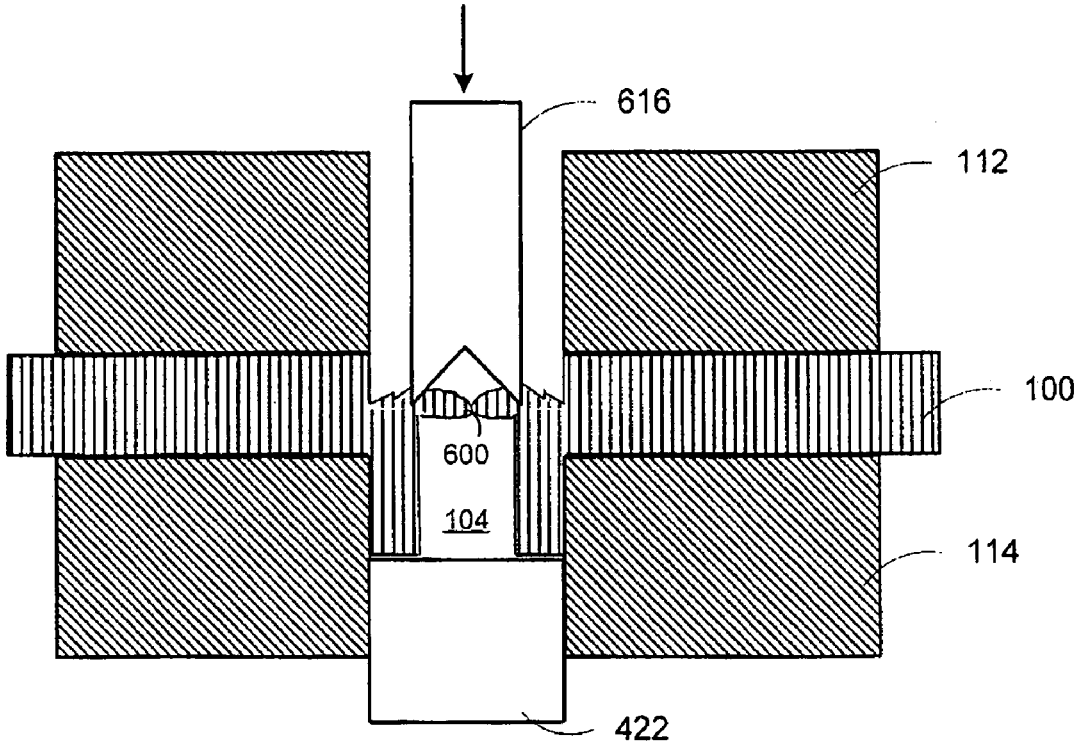
FIG. 6 is a partial cross sectional view showing a third tapered pin shearing material towards the center of the top opening of the hollow projection, and forming a continuous layer over the top opening of the hollow projection.

FIGS. 5 and 6 illustrate a process to continue sealing the top opening of the hollow projection 104 using additional tapered pins having progressively decreasing diameters. One or more narrower tapered pins may be required to apply additional force to shift sheared material 400 towards the center of the top opening. In FIG. 5, a second tapered pin 516 having a smaller diameter than the first tapered pin 416 is used and in FIG. 6, a third tapered pin 616 with an even smaller diameter is used.

Figure 7:
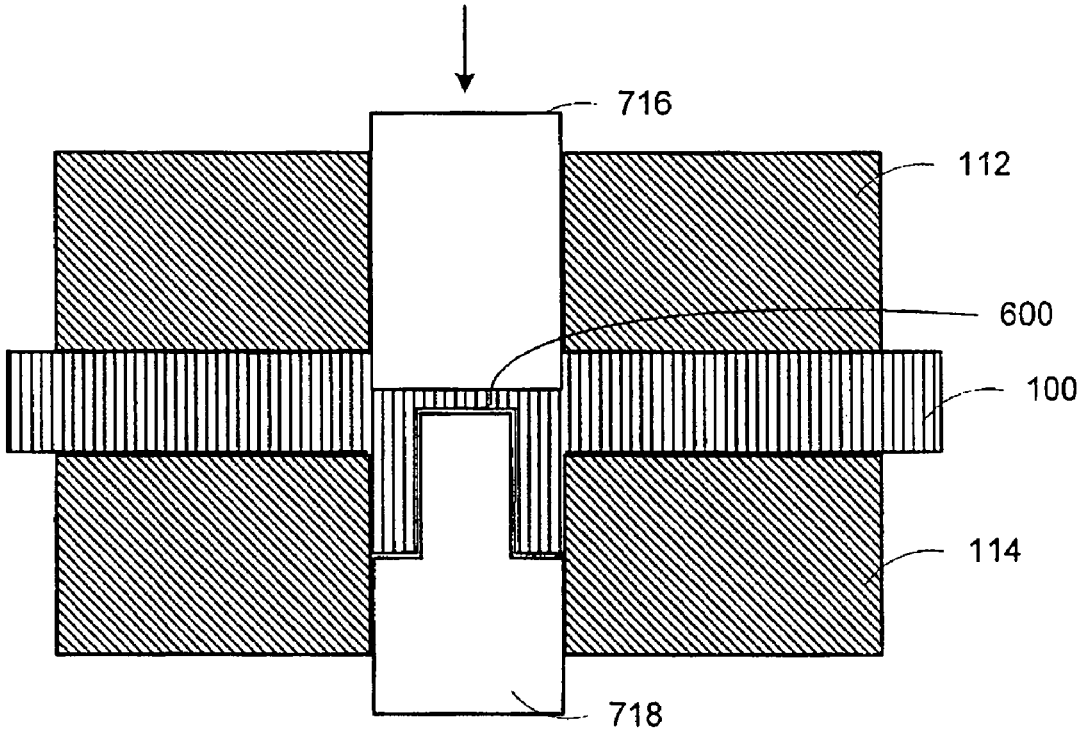
FIG. 7 is a partial cross sectional view showing a flat pin punching the continuous layer over the top opening of the hollow projection.

After the first tapered pin 416 and additional tapered pins 516 and 616 have been used, a continuous layer 600 of sheet material forms a sealed and 600 over the hollow projection 104 (shown in FIG. 6), which is airtight. The sealed end 600 may have an uneven surface resulting from the shearing process. If a smooth surface is desired, the uneven surface may be smoothed by placing a support pin 718 under the sealed end 600 and punching a flat punch pin 716 over the sealed end 600 to compress the sealed end 600 into a desired shape (shown m FIG. 7).

FIG. 8 shows a side cross-sectional view of a blind hole formed in a sheet material 100 according to the first aspect of the present invention. The sheet material 100 as shown has a thickness of D1. The blind hole projects from a bottom surface of the sheet material 100 and has a depth D2, where D2 is greater than D1, and an internal diameter D3. The recessed segment 102 is formed in a top surface of the sheet material 100 and has an internal diameter D4, where D4 is greater than D3. As illustrated in FIG. 8, the recessed segment 102 is integral with the sealed end 600 of the blind hole.

An advantage of forming blind holes in a sheet material using the above-described method is that the depth D2 of the blind hole can be greater than the thickness D1 of the sheet material 100. Further, by adjusting the internal diameter of the recessed segment D4 and the internal diameter D3 of the blind hole, a greater depth D2 of the blind hole can be achieved even though the thickness D1 of the sheet material 100 is unchanged. In addition, the blind hole formed in the present invention is airtight which is particularly important in applications where the leakage of air must be prevented.

For example, the sheet material 100 in a hard disk drive may have a thickness of between about 1 to about 3 mm. The resulting blind hole may have an internal diameter of about 2.6 mm, a sidewall thickness of about 0.5 mm and a depth of about 4 to about 5 mm. The sheet material 100 of the present invention is typically made of a malleable material, which may comprise a metallic element, such as, aluminum, iron and steel.

Figure 9:
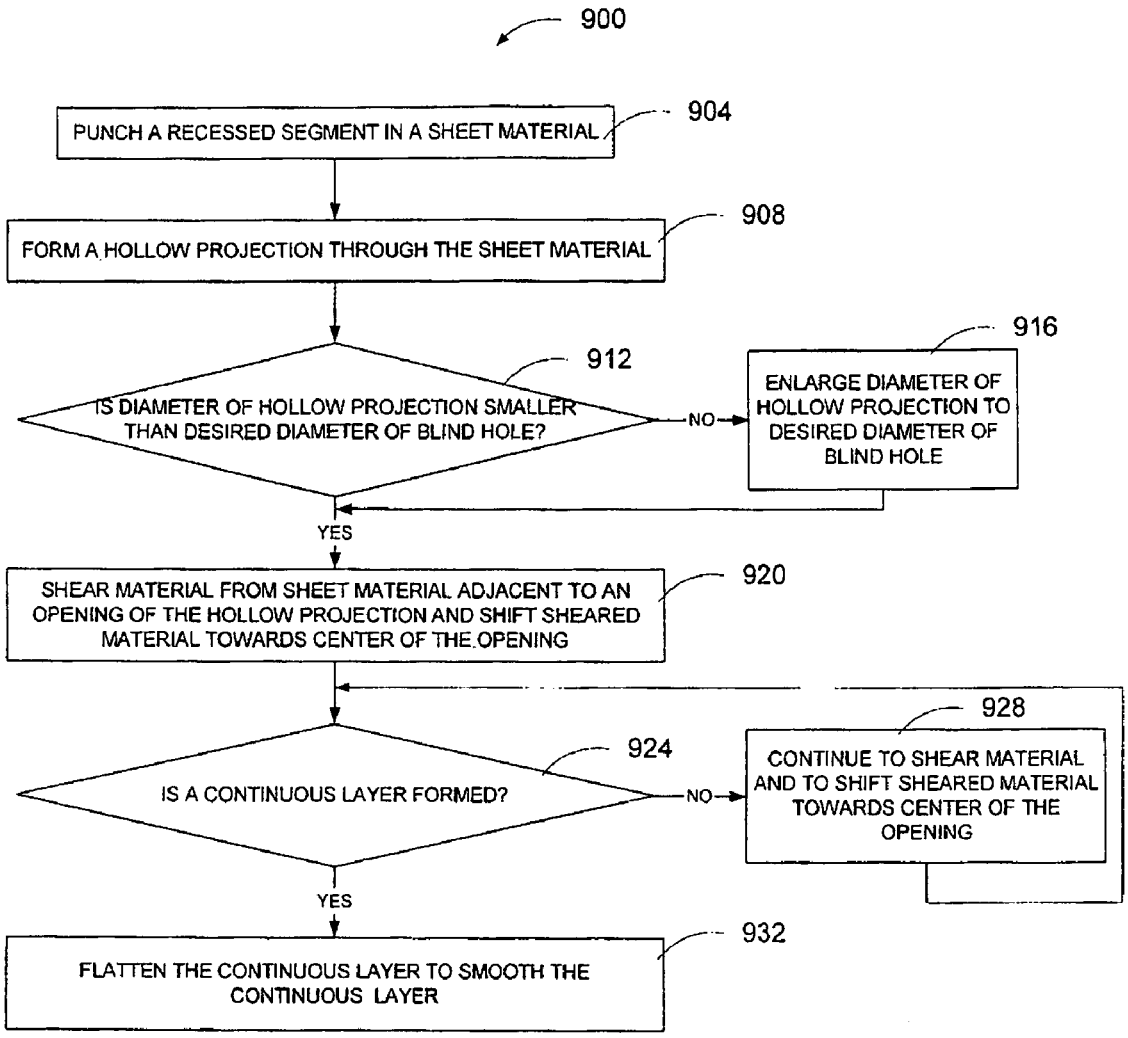
FIG. 9 illustrates a flow chart of forming a blind hole.

FIG. 9 illustrates a flow chart of a method 900 of forming a blind hole in a sheet material 100 according to a first aspect of the present inventor. Method 900 begins at a block 904 when a recessed segment is punched into the sheet material. Thereafter, a hollow projection is formed in the sheet material in a block 912. If the diameter of the hollow projection is not sufficiently large in a block 912, the hollow projection may be enlarged to the desired diameter by driving an enlarging pin into the hollow projection in a block 916.

After the desired diameter of the blind hole is obtained, method 900 proceeds to shear material adjacent to an opening of the hollow projection and to shift the sheared material towards a center of the opening to form a continuous layer over the opening in a block 920. This is achieved by using a first tapered pin having a cutting edge for shearing the material, and having a tapered internal wall to shift the sheared material to the center of the opening.

In a block 924, method 900 then determines whether a continuous layer has been formed over the opening. If the continuous layer has not been formed, additional tapered pin with progressively decreasing diameters may be used to continue the shearing process until a continuous layer forms a sealed end over the hollow projection in a block 928. Further processing may be needed to flatten or compress the sealed end into a desired shape in a block 932.

Figure 10:
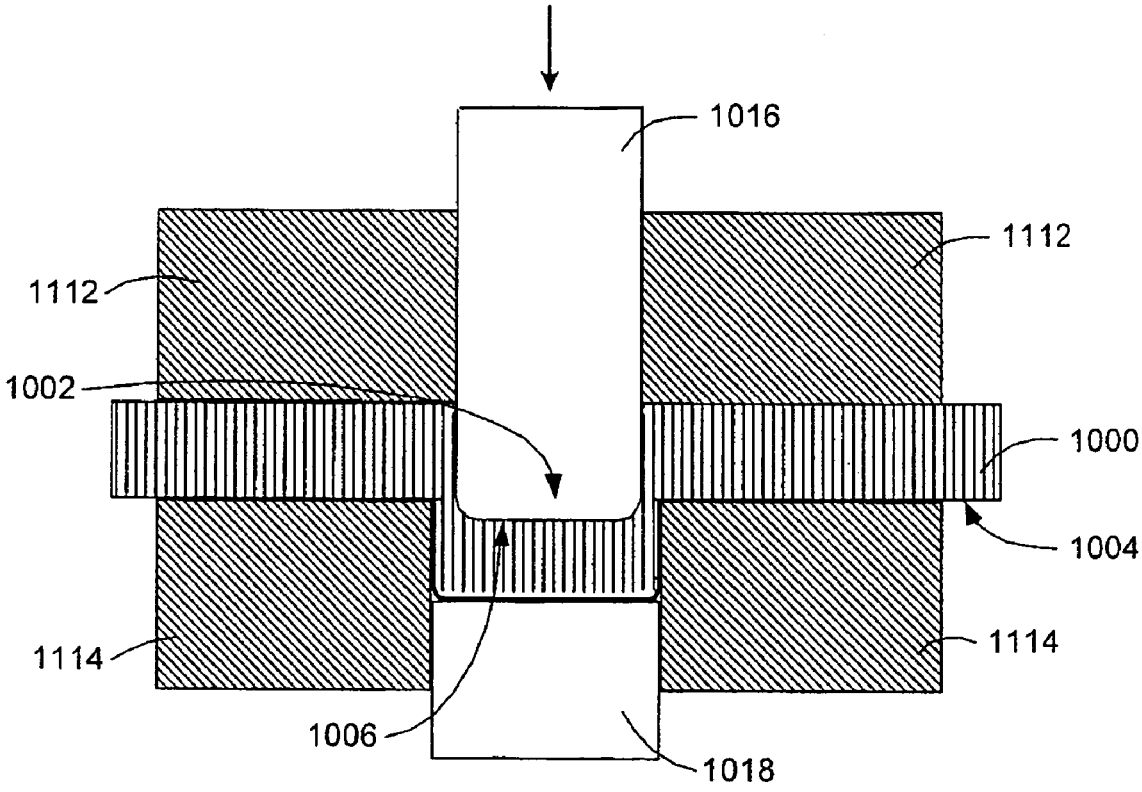
FIG. 10 illustrates a partial cross-sectional view of forming a recessed segment on a sheet material.

FIG. 10 illustrates a process of forming a recessed segment 1002 in a sheet material 1000, which is secured between an upper die 1112 and a lower die 1114. A recess pad 1018 is placed under the sheet material 1000 to receive the recessed segment 1002 and to define the depth of the recessed segment 1002. A recess punch 1016 is used to punch the sheet material 1000 from its top surface against the recess pad 1018 to form the recessed segment 1002 on the sheet material 1000.

The recess punch 1016 may have a rounded edge so that the edge of the recess punch 1016 does not perforate the sheet material 1000 when the recess punch 1016 is driven against the sheet material 1000. The recessed segment 1002 may be drawn downwards until a top surface 1006 of the recessed segment 1002 extends lower than a bottom surface 1004 of the sheet material 1000. An advantage of drawing the recessed segment 1002 lower than the bottom surface 1004 of the sheet material 1000 is that the extruded sidewall height of the resultant blind hole from the bottom surface 1004 is increased.

Figure 11:
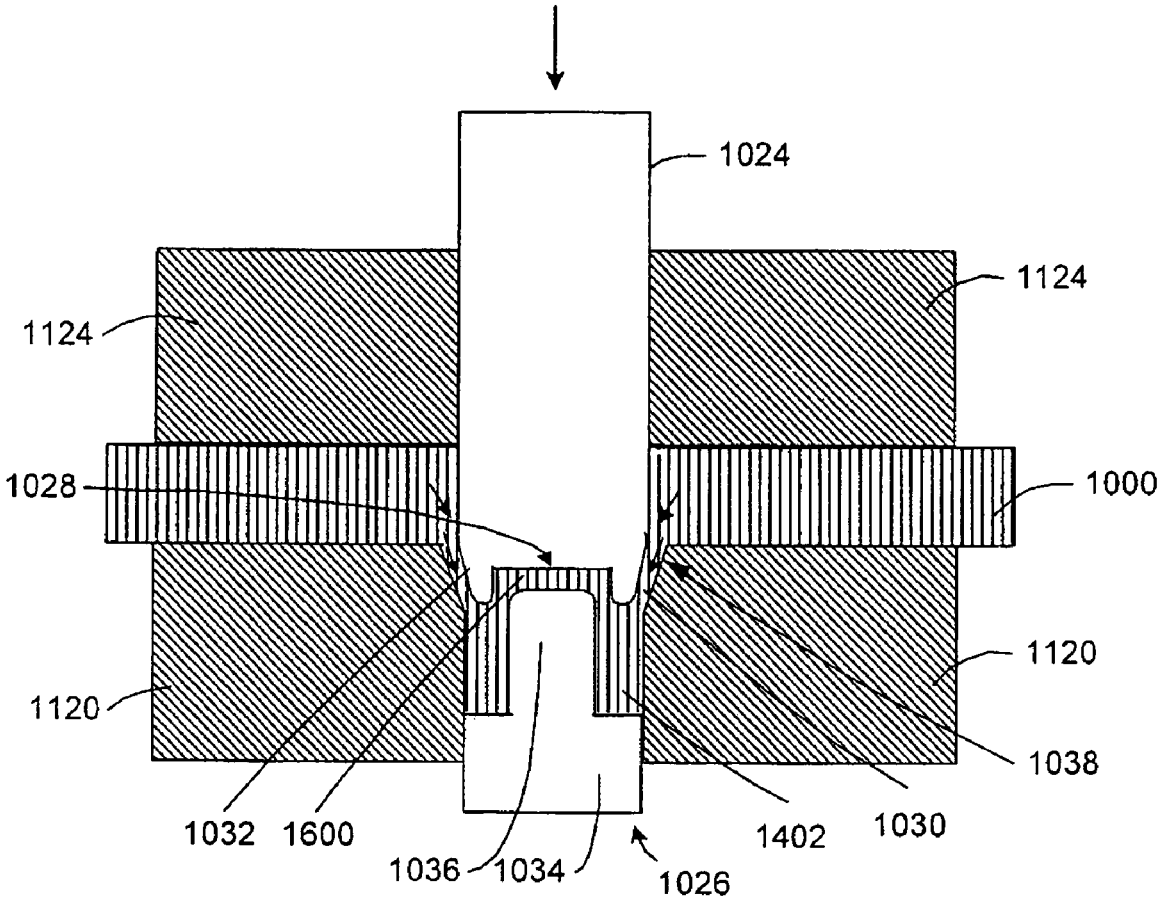
FIG. 11 illustrates a partial cross-sectional view of forming a blind hole on the recessed segment.

FIG. 11 illustrates a process of forming a blind hole in the recessed segment 1002 of the sheet material 1000. A tapered punch 1024 is used to stamp the recessed segment 1002 from its top surface 1006 against a pad 1026. The pad 1026 includes a support portion 1034 and a profiling pin 1036 that projects from the support portion 1036 the support portion 1034 shapes the sidewall 1402 at the open end of the blind hole while the profiling pin 1036 determines the height of the sidewall 1402. The diameters of the support portion 1034 and profiling pin 1036 may be varied to control the diameters desired for the blind hole.

The tapered punch 1024 has a contact surface having a recess 1028 for shaping and defining a sealed end 1600 of the blind hole. The recess 1028 is enclosed by a tapered ridge 1032, which has an internal and an external surface. The internal surface of the tapered ridge 1032 defines the sealed end of the blind hole when the recessed segment 1002 is compressed between the tapered punch 1024 and the pad 1026. The external surface of the tapered ridge 1032 is tapered and may be used to compress or apply pressure to a material channel 1030 interposed between the tapered punch 1024 and a tapered die 1120. When pressure is applied to the material channel 1030, a material flow is generated to shift material from the material channel 1030 to thicken the sidewall 1402 A chamfered edge 1038 is provided on the tapered die 1120 to compress the material channel 1030 between the chamfered edge 1038 and the tapered ridge 1032 to narrow or constrict the material channel 1030. Thus, the material channel 1030 may be made less thick than the sidewall 1402 to provide a blind hole with a sufficiently thick sidewall 1402.

FIG. 11 also illustrates a partial cross-section view of a stamping tool that may be used to form a blind hole in a sheet material in a process described above. The stamping tool comprises an upper die 1124 attached to a tapered punch 1024. The stamping tool also comprises a lower tapered die 1120 positioned to secure a sheet material 1000 between the upper die 1124 and the tapered die 1120. The lower tapered die 1120 includes a pad 1026 to define a blind hole in the sheet material 1000 when the tapered punch 1024 stamps the sheet material 1000 against the pad 1026. The pad 1026 may include a support portion 1034 and a profiling pin 1036 to shape the blind hole with desired dimensions.

A chamfered edge 1038 is positioned on the tapered die 1120 such that the chamfered edge 1038 and the tapered punch 1024 may compress a portion of the sheet material 1000 to form a material channel 1030. The material channel 1030 is compressed to channel a material flow into a sidewall 1402 of the blind hole. The material channel 1030 may be narrowed or constricted such that it is less thick than the sidewall 1402.

The tapered punch 1024 has a contact surface having a recess enclosed by a tapered ridge 1032. The tapered ridge 1032 has an internal surface for defining a sealed end of the blind hole, and an external surface for compressing the material channel 1030 against the chamfered edge 1038 of the tapered die 1120.

The upper die (1112, 1124) and the tapered die 1120 may be coupled to a mechanical or hydraulic system, which are then coupled to a controller. The controller is then used to control the force, speed and precision with which the upper die (1112, 1124) is driven against the lower die 1114 and/or tapered die 1120 in the processes of FIG. 10 and FIG. 11.

Figure 12:
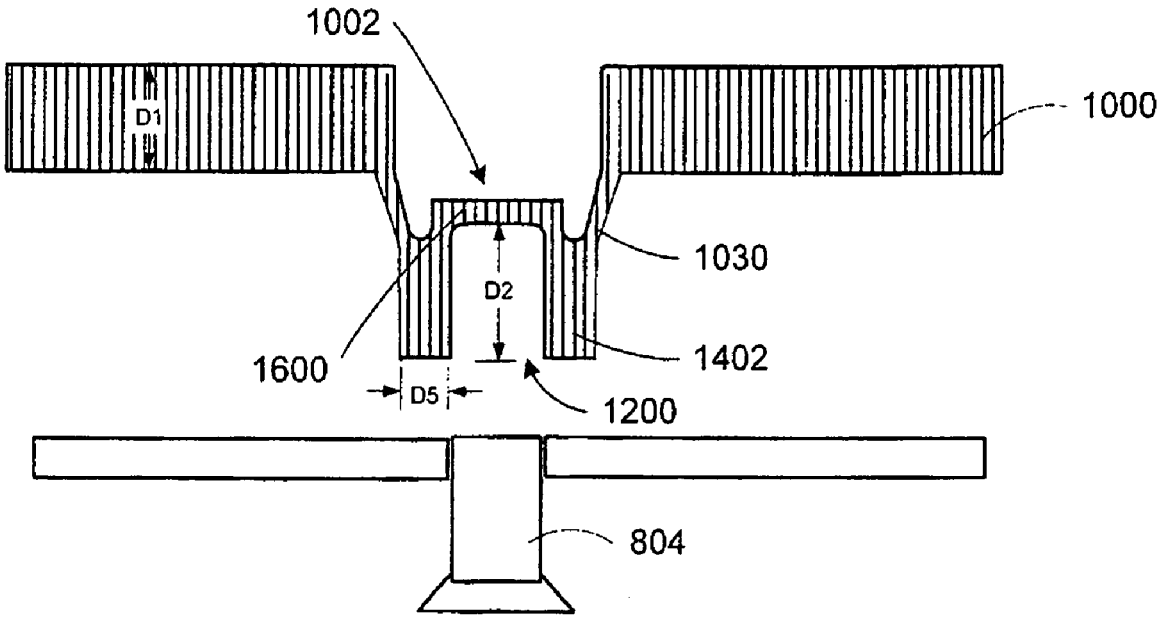
FIG. 12 illustrates a cross-sectional view of a blind hole formed in a sheet material.

FIG. 12 illustrates a side cross-sectional view of a blind hole 1200 formed in a sheet material 1000 using the processes illustrated in FIG. 10 and FIG. 11. When the present invention is used to form a hard drive casing, the sheet material 1000 may have a thickness D1 of about 2 mm. The blind hole 1200 has a depth D2 of about 4 mm to about 5 mm. The sidewall thickness D5 of the blind hole can be improved by about fifty percent compared to the sidewall thickness of blind holes formed in the prior art In this particular example, a sidewall thickness of about 1 mm can be achieved. Improved sidewall thickness increases the strength of the blind hole and is also more aesthetically pleasing. If the blind hole is tapped to form screw threads in the internal surface of the sidewall 1402, the additional thickness prevents breakage.

To achieve improved sidewall thickness the material channel 1030 of the blind hole may be narrowed or constricted to a thickness less than that of the sidewall 1402. The material channel 1030 also allows the sealed end 1600 of the blind hole to be displaced from the sheet material 1000 so that the blind hole sidewall 1402 may extrude further from the sheet material 1000. This enables longer screws or bolts to be mounted in the blind hole and thicker PCBs to be mounted onto the sheet material 1000. Also, the recessed segment 1002 contributes to the increased extrusion of the blind hole sidewall 1402. For example, a sheet material 1000 having a 2 mm thickness may be drawn downwards by about 2.5 mm from a top surface of the sheet material 1000 in the process illustrated by FIG. 10.

The above-described methods of forming blind holes are suitable for use in casing for hard disk drives, where PCBs and motors are mounted to the casing. FIG. 8 and FIG. 12 further illustrate a PCB board 802 and a mounting screw 804 for mounting the PCB board 802 to the sheet material (100 or 1000), which may be processed to form part of a hard disk drive casing. Because the interior of a hard disk drive is very sensitive and may be easily damaged by particles in the air, the air-tight seal of the blind holes is extremely important to maintain system integrity.

While the foregoing description refers to forming a blind hole with cylindrical configuration with circular cross-section, the described methods are equally applicable to forming blind hole of other geometrical cross-sections, such as, an ellipse, a rectangle and a polygon with a plurality of sides.

Other embodiments of the invention will be apparent to those skilled in the art from consideration of the specification and practice of the invention. Furthermore. certain terminology has been used for the purposes of descriptive clarity, and not to limit the present invention. The embodiments and features described above should be considered exemplary, with the invention being defined by the appended claims.

What is claimed is:

1. A method for forming a blind hole in a sheet of material, comprising;

placing a sheet material between a first upper die and a first lower die;

punching a recess punch into a through opening in said first upper die, to force a portion of said sheet material against a recess pad that inserts into a portion of a through opening of said first lower die to form a recess segment;

placing said sheet material between a second upper die and a second lower die;

punching down a tapered punch into a through opening of said second upper die, scraping a portion of material along a sidewall of said recess segment downwardly;

compressing said portion of material onto said recess segment of said sheet material against a support pad that inserts into a portion of a through opening of said second lower die to form a material channel between said sheet material and recess segment of said sheet material, wherein said tapered punch has an edge that inclines inward, and edges surrounding a top surface of said through opening of said second lower die are chamfered; and defining a sidewall at an open end of said recess segment with a support portion of said support pad while a profiling pin of said support pad determines a height of said sidewall of an open end of said recess segment to form a blind hole on a bottom surface of said recess segment.

2. The method as recited in claim 1, wherein a top surface of said recess segment is lower than a bottom surface of other portions of said sheet material.

3. The method as recited in claim 1, wherein said material channel is constricted to a thickness less than that of a sidewall of said recess segment.

4. A system for forming a blind hole in a sheet material, comprising:

a first upper die with a through opening;

a first lower die with a through opening, wherein said sheet metal is placed between said first upper die and said first lower die;

a recess pad that inserts into a portion of said through opening of said first lower die; a recess punch that inserts into said through opening of said first upper die, wherein said recess punch forces a portion of said sheet material against said recess pad to form a recess segment;

a second upper die with a through opening;

a second lower die with a through opening, wherein said through opening of said second lower die has a chamfered edge;

a tapered punch that inserts into said through opening of said second upper die, wherein said tapered punch has a tapered edge that inclines inward;

a support pad that inserts into a portion of said second lower die, wherein said tapered punch forces a portion of said sheet material placed between said second upper die and said second lower die against said support pad to form a blind hole on a bottom surface of said recess segment.

5. The system as recited in claim 4, wherein said support pad comprises a support portion.

6. The system as recited in claim 4, wherein said support pad comprises a profiling pin.

* * * * *